US005918993A

United States Patent [19]

Koyama

[11] Patent Number: 5,918,993

[45] Date of Patent: Jul. 6, 1999

[54] CLICKING-TYPE WRITING IMPLEMENT

[75] Inventor: Hiroaki Koyama, Kanagawa, Japan

[73] Assignee: Mitsubishi Pencil Kabushiki Kaisha, Tokyo, Japan

[21] Appl. No.: 08/696,353

[22] Filed: Aug. 13, 1996

[30] Foreign Application Priority Data

Apr. 18, 1996 [JP] Japan ..... 8-119581

[51] Int. Cl.[6] ..... B43K 7/12; B43K 24/00

[52] U.S. Cl. ..... 401/106; 401/109; 401/209

[58] Field of Search ..... 401/104, 105, 401/106, 109, 209

[56] References Cited

U.S. PATENT DOCUMENTS

| | | | |
|---|---|---|---|
| 3,326,189 | 6/1967 | Baer | 401/105 |
| 3,637,316 | 1/1972 | Bross | 401/104 |
| 3,819,282 | 6/1974 | Schultz | 401/105 |

FOREIGN PATENT DOCUMENTS

| | | | |
|---|---|---|---|
| 722976 | 12/1965 | Canada | 401/106 |
| 3312770 | 10/1984 | Germany | 401/104 |

*Primary Examiner*—Steven A. Bratlie
*Attorney, Agent, or Firm*—Darby & Darby

[57] ABSTRACT

A clicking-type writing implement includes a writing member having a writing portion at its tip, and a clicking rod for projecting the writing member from a barrel cylinder. When the clicking rod is depressed to engage an engaging portion of a rotor in the barrel cylinder with an engaging surface of a clip cylinder, the writing portion is maintained to project from the barrel cylinder. A cam surface is formed on the inner surface of the barrel cylinder. A cam projection inclined surface which moves and rotates along a cam inclined surface of the barrel cylinder is formed on the rotor to project and retract the writing member. An engaging portion to engage with the engaging surface of the clip cylinder is formed in front of the cam projection inclined surface.

2 Claims, 9 Drawing Sheets

CLICKING-TYPE WRITING IMPLEMENT

BACKGROUND OF THE INVENTION (1) Field of the Invention

The present invention relates to a clicking-type writing implement, a writing member of which is projected from the shaft tip by depressing a clicking rod at the rear end of the implement, thus permitting writing.

(2) Description of the Prior Art

A conventional clicking-type ball-point pen performs writing by projecting its writing member from its shaft tip. When storing this clicking-type ball-point pen in a pocket, if the user forgets to retract the writing member into the shaft, the writing portion is left projected outside the shaft, sometimes staining the user's clothes with ink. In a proposal made to solve this problem, when storing the writing implement in the pocket, the engaging portion of a clip and an engaging portion provided to the shaft or in the shaft are made to engage with each other, so that the writing member is reliably retracted in the shaft. As an example of such a mechanism, one that operates as follows is generally employed. More specifically, the writing portion of the writing member is projected from the shaft tip by depressing a clicking rod at the rear end of the shaft. Thereafter, when retracting the writing member, the rear end side of the clip is depressed to disengage the writing member, so that the writing member is retracted in the shaft. In this case, however, different portions are operated when projecting the writing member and when retracting the writing member, leading to a poor operability. When a direct supply-type writing member is loaded in the ball-point pen, ink in the writing member may shift or leak or air may be trapped in the ink from the tip of the writing member due to the impact applied to the writing member upon disengagement, thus causing ink starving. Therefore, a mechanism for reducing the impact applied to the writing member is needed.

SUMMARY OF THE INVENTION

The present invention mainly aims at improving a popular clicking-type writing implement having a safety mechanism. According to the present invention, a mechanism which ensures the projecting and retracting operations of a writing member and which has a good operability is realized, thus preventing the user's clothes from being accidentally stained when storing the writing implement in the pocket of the clothes, the problems of cost and assembly are solved by decreasing the number of components, and a requirement for a decrease in clicking impact applied to the writing member is satisfied. It is an object of the present invention to solve these problems.

In order to solve the above problems, according to the first aspect of the present invention, there is provided a clicking-type writing implement comprising a writing member having a writing portion at a tip thereof, a return spring for urging the writing member toward a rear of the implement. A clicking rod projecting from a rear end of a barrel cylinder is provided to interlock with the writing body. A double clicking mechanism, in which the writing member is maintained to project from a tip when the clicking rod is depressed and the writing member is disengaged by further depressing the clicking rod so that the writing portion is retracted, has a safety mechanism with a cam surface formed on an inner surface of the barrel cylinder. A cam projection inclined surface formed on a rotor, moves and rotates along a cam inclined surface of the barrel cylinder in order to project and retract the writing member. The writing portion is maintained to project through engagement of an engaging portion, formed in front of the cam projection inclined surface, and an engaging surface formed on a clip cylinder, such that when a clip is lifted, the engaging portion and the engaging surfaces disengage from each other so that the writing portion can retract.

According to the second aspect of the present invention, there is provided a clicking-type writing implement characterized in that, in the first aspect of the present invention, a relation P>Q holds where P is a distance from a lower end face of a side wall surface to an axial center for which the engaging portion of the rotor travels until the engaging portion engages with the engaging surface of the clip cylinder, and Q is a distance from the lower end face of the side wall surface to the axial center for which the engaging portion of the rotor travels until the engaging portion disengages from the engaging surface.

The above arrangement will be described in more detail. The clicking-type writing implement of the present invention has a writing member having a writing portion at its tip, a return spring for urging the writing member toward rear, and a clicking rod interlocked with the writing member to project from a barrel cylinder. When the clicking rod is depressed, the writing member is projected. When the engaging surface of the clip cylinder engages with the engaging portion of the rotor, the projecting state of the writing member is maintained. In a conventional retractable ball-point pen, the projecting state of the writing member is maintained when the projection of the rotor and part of the cam in the barrel cylinder engage with each other. In contrast to this, according to the present invention, the projection of the rotor and part of the cam in the barrel cylinder do not engage with each other to maintain the projecting state of the writing member.

The rotor is inserted between the clicking rod and the writing member. When the clicking rod is depressed, the force applied in the axial direction is converted into a force in the circumferential direction by the cam inclined surface of the clicking rod and a corresponding cam inclined surface of the rotor. At this point, the clicking rod is provided with a rotation stopper, and a groove corresponding to this rotation stopper is formed in the clip cylinder. Thus, the clicking rod does not rotate in the circumferential direction, and only the rotor rotates for a predetermined angle in the circumferential direction. Furthermore, the writing member is constantly urged toward the rear of the barrel cylinder by the return spring. When depression on the clicking rod is stopped, the rotor is rotated for a predetermined angle by the cam projection inclined surface of the rotor and the corresponding cylinder cam surface formed on the barrel cylinder. As the rotor rotates for a predetermined angle, the engaging portion of the rotor engages with the engaging surface of the clip cylinder. The engaging distance P from the lower end face of the side wall surface of the clip cylinder to the axial center and the disengaging distance Q from the lower end face of the side wall surface to the axial center are different from each other. For this reason, a clicking stroke necessary for the engaging portion of the rotor to engage with the engaging surface of the clip cylinder can be decreased, and the reliability of this movement can be improved.

In this state, when the clicking rod is depressed or the clip is lifted, the engaging surface of the clip cylinder and the engaging portion of the rotor disengage from each other. The cam projection inclined surface of the rotor moves rearward while rotating along the cam inclined surface of the barrel cylinder, and the writing portion is retracted in the barrel cylinder. Regarding cams required for these operations, the shapes, angles, and number of cams can be selected as required.

The operation of the above means will be described below. In a clicking type ball-point pen in which the writing portion of the writing member is projected from the tip of the barrel cylinder by depressing a clicking rod projecting backward from the shaft, thus enabling writing, the projecting state of the writing member can be maintained through engagement of the engaging surface of the clip cylinder and the engaging portion of the rotor. When the bead portion of the clip cylinder is lifted, this engagement is canceled and the writing portion is retracted in the barrel cylinder. As a result, even if the user puts the ball-point pen in the pocket of his or her clothes with the writing portion projecting from the barrel cylinder, the writing portion is automatically retracted in the barrel cylinder, so that the clothes will not be accidentally stained with ink. The writing portion can be projected and retracted by only depressing the clicking rod, and the impact generated when retracting the writing portion is largely reduced by the user's finger which is in contact with the clicking rod. Hence, even a writing member with medium-viscosity ink which cannot be conventionally loaded can be used in a ball-point pen. The projection of the rotor does not project to the outside of the barrel cylinder, and the clip bead portion has no projecting corner portion. Consequently, the ball-point pen can be easily put in and taken out of the pocket or the like smoothly. The clicking stroke can be shortened, and the reliability of the operation is improved, thus further improving operability.

DESCRIPTION OF THE PREFERRED EMBODIMENT

Figure 1:
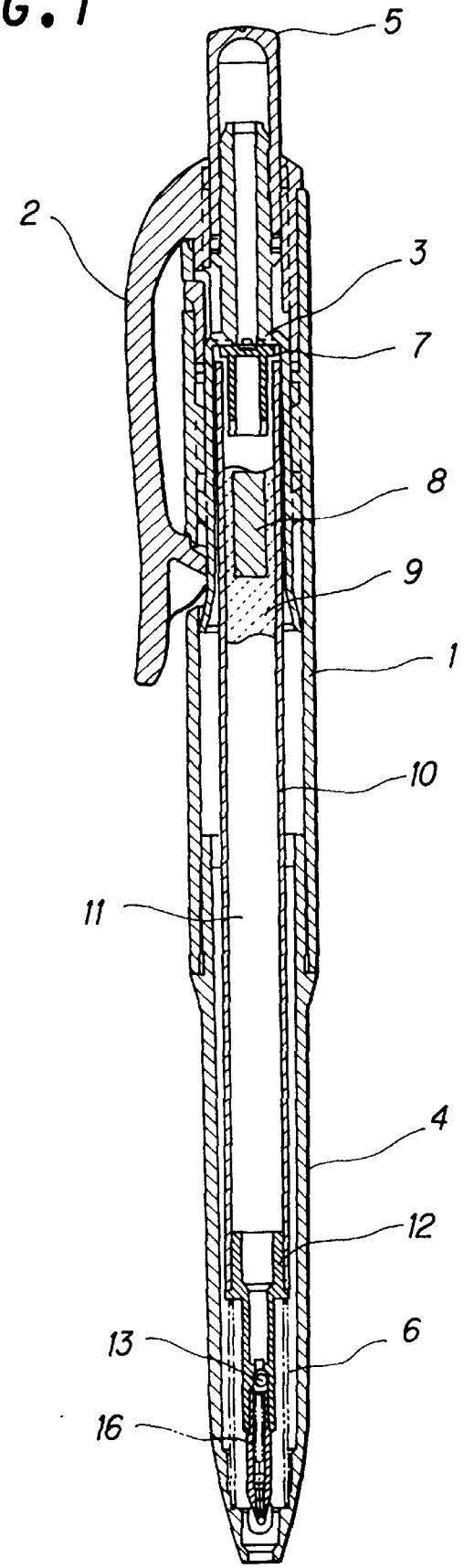
FIG. 1 is a longitudinal sectional view showing the entire structure of a writing implement according to an embodiment of the present invention.
Figure 2:
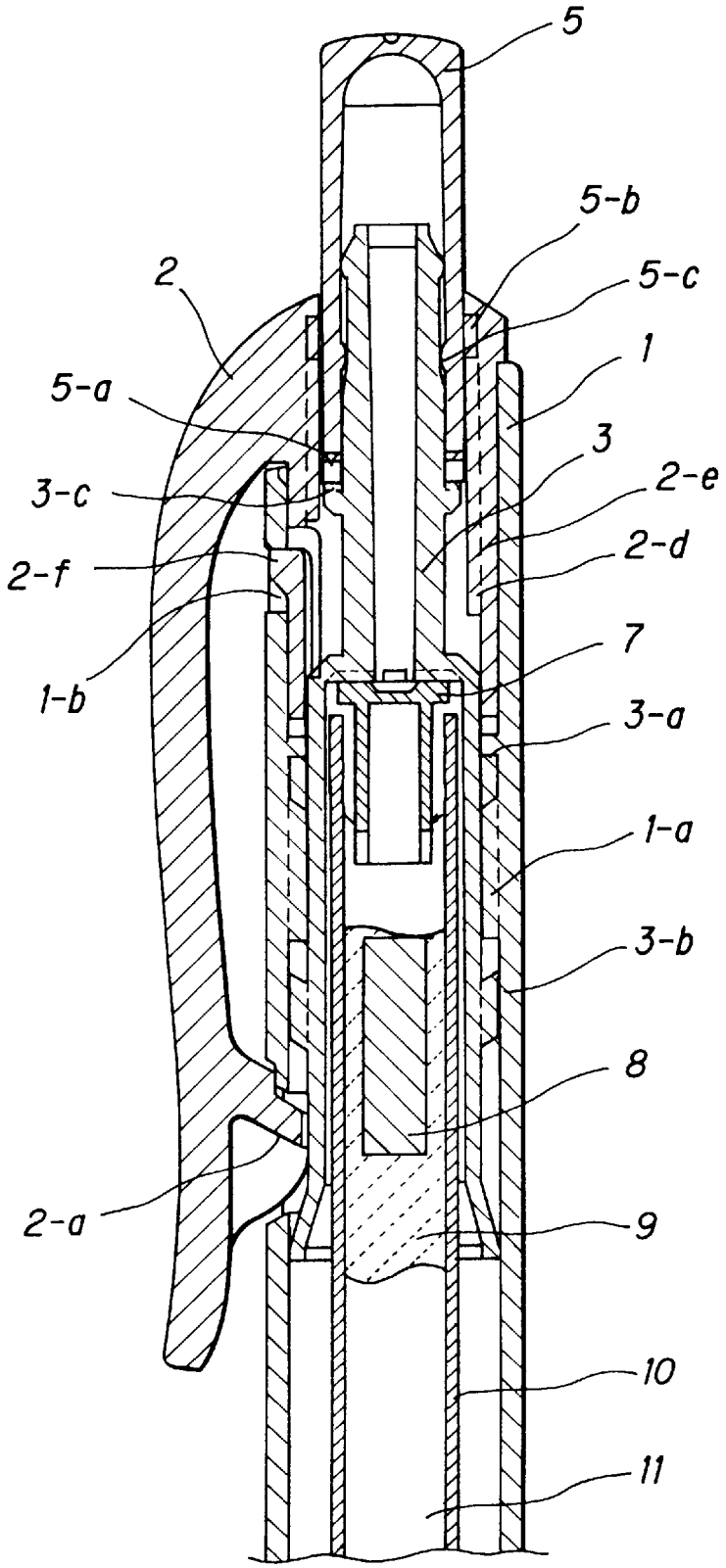
FIG. 2 is a longitudinal sectional view showing the structure of the rear end portion of the writing implement according to the embodiment of the present invention.
Figure 3:
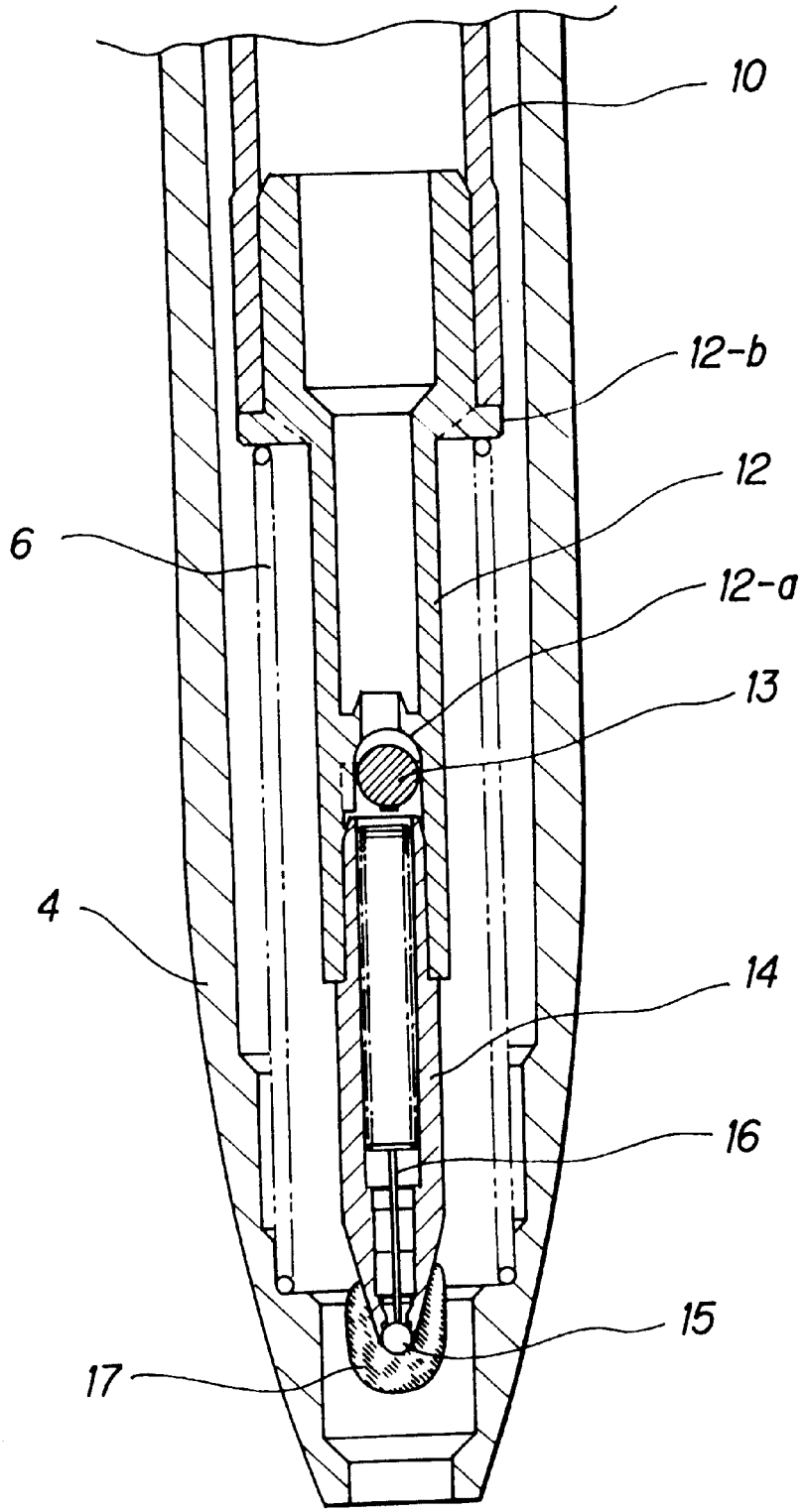
FIG. 3 is a longitudinal sectional view showing the structure of the tip portion of the writing implement according to the embodiment of the present invention.
Figure 4:
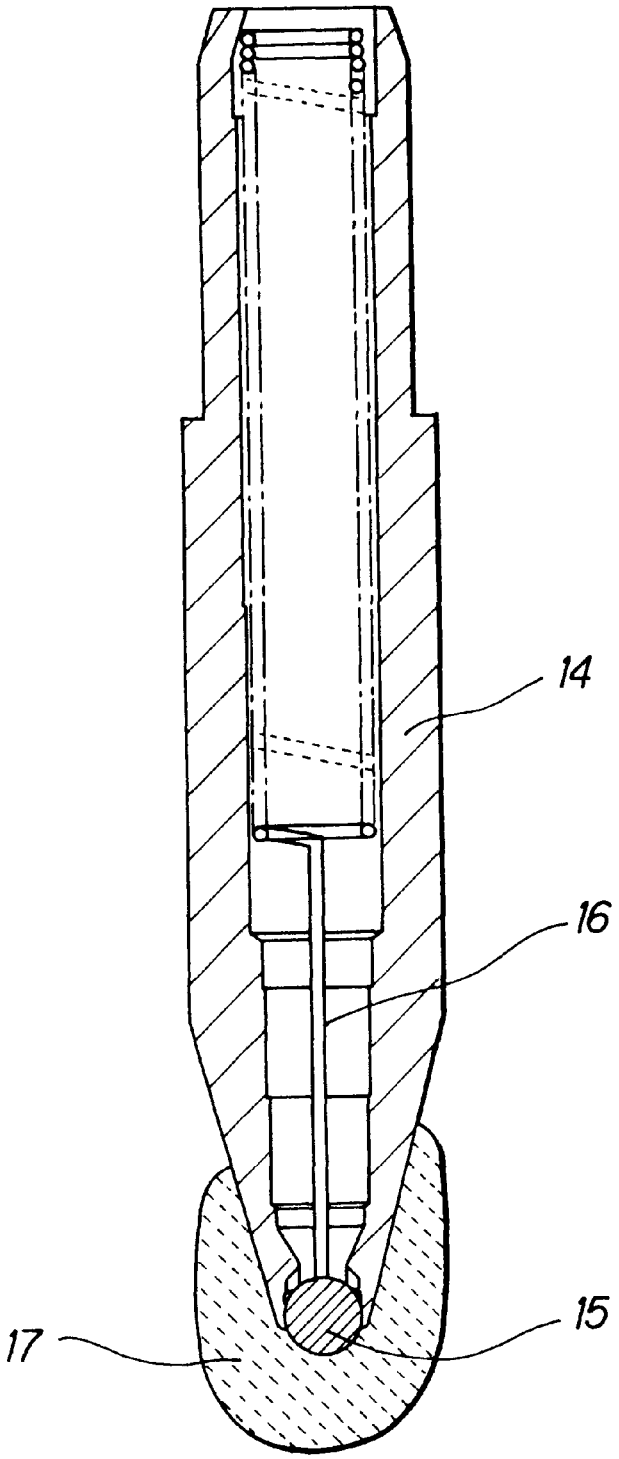
FIG. 4 is a longitudinal sectional view showing the structure of a writing portion as a part of the embodiment of the present invention.
Figure 5:
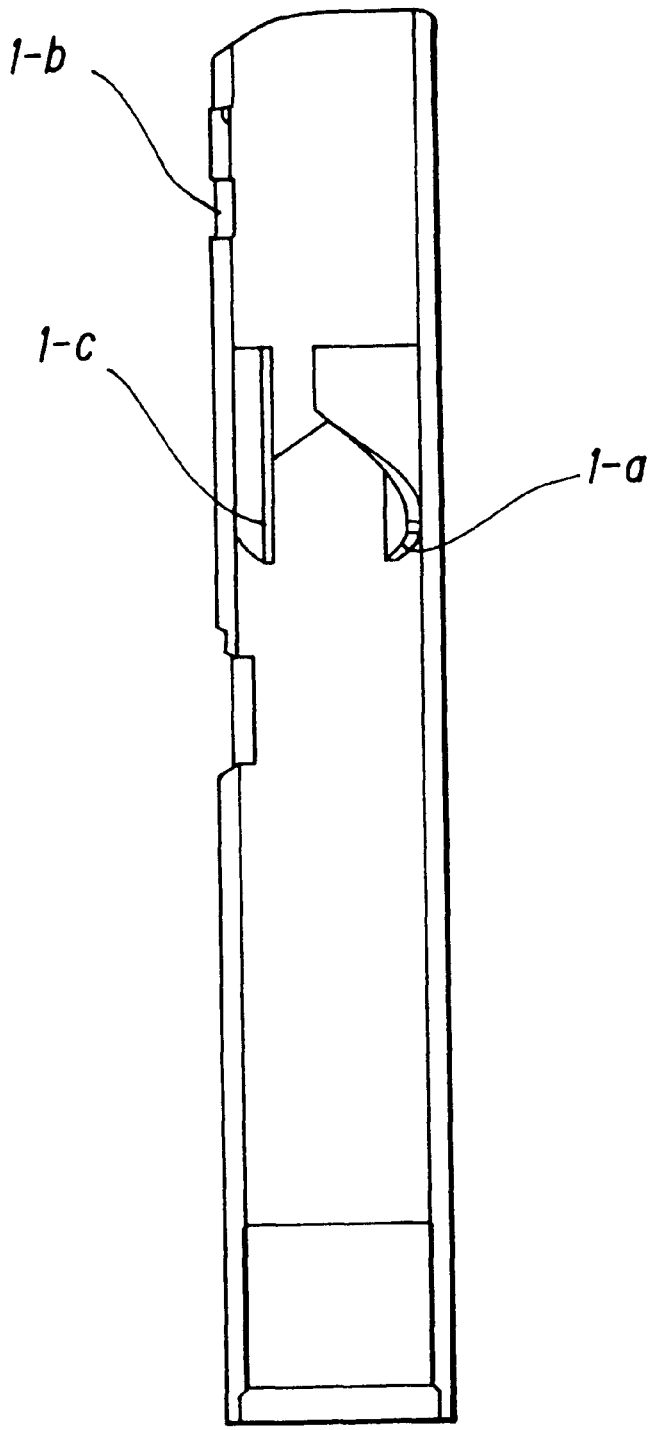
FIG. 5 shows the outer appearance of a barrel cylinder as part of the embodiment of the present invention.
Figure 6A:
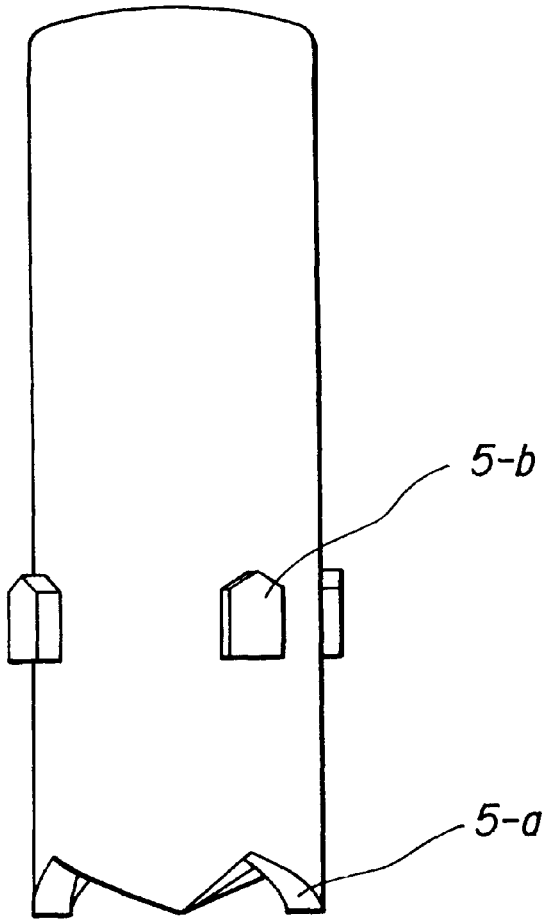
FIG. 6A shows the outer appearance of a clicking rod as part of the embodiment of the present invention.
Figure 6B:
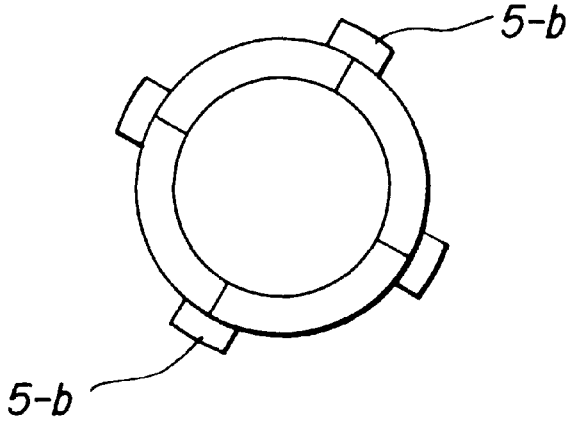
FIG. 6B is a bottom view of FIG. 6A.
Figure 7:
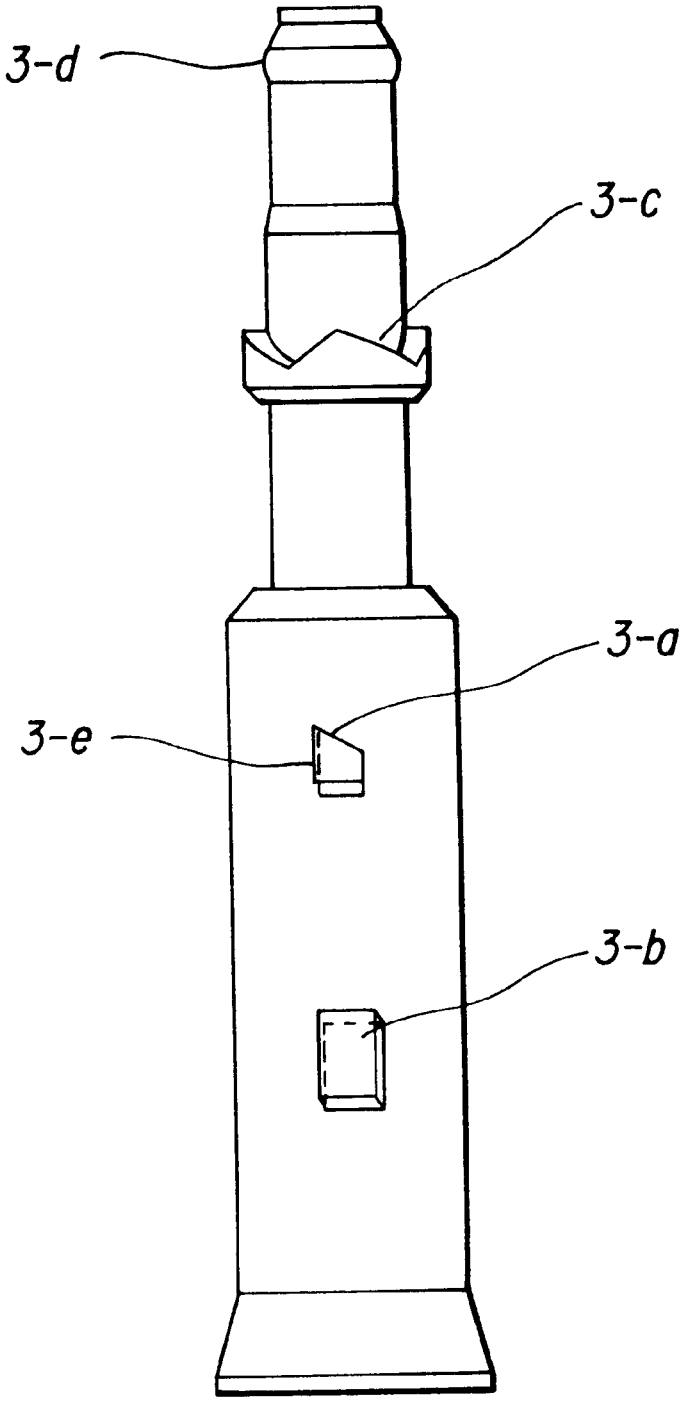
FIG. 7 shows the outer appearance of a rotor as part of the embodiment of the present invention.
Figure 8A:
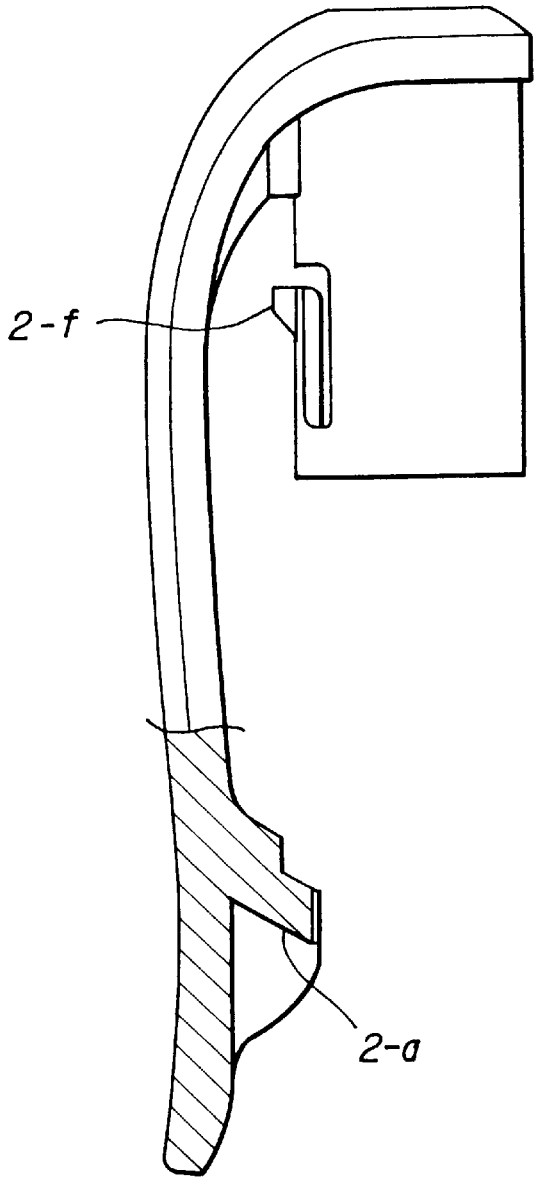
FIG. 8A shows the outer appearance of a clip cylinder as part of the embodiment of the present invention.
Figure 8B:
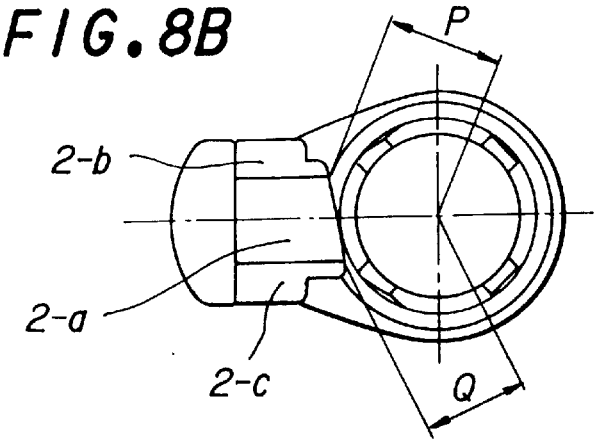
FIG. 8B is a bottom view of FIG. 8A.
Figure 9A:
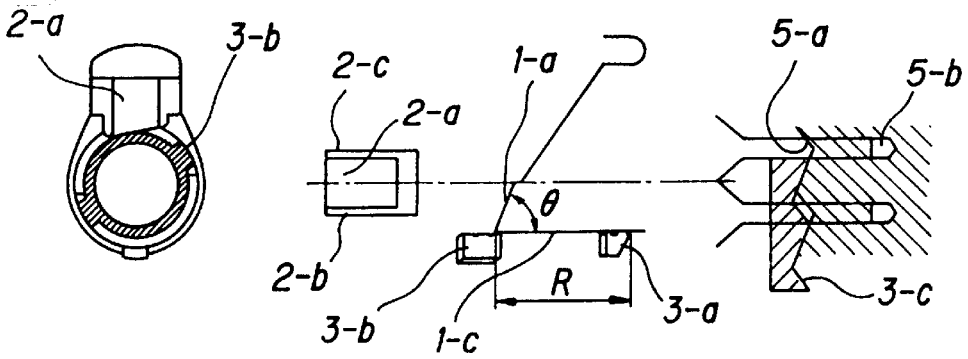
FIGS. 9A–9D include schematic developments showing the mechanism portion of the writing portion as part of the embodiment of the present invention.
Figure 9B:
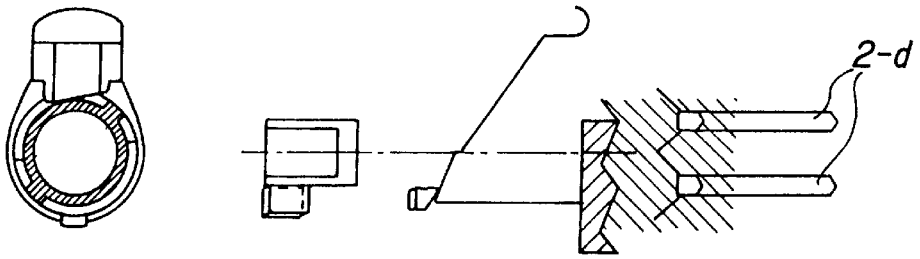
Figure 9C:
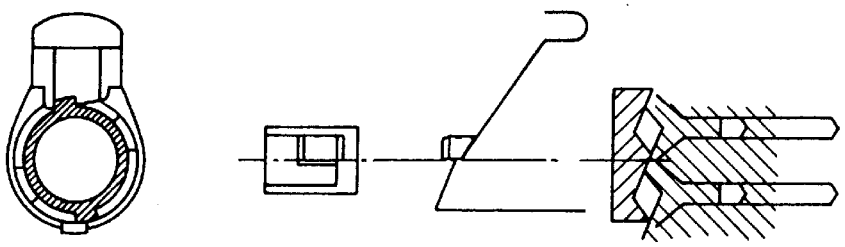
Figure 9D:
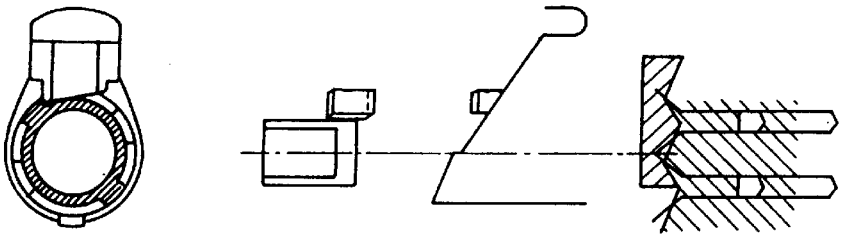

FIGS. 1 to 9 show the embodiment of the present invention. As shown in FIGS. 1 to 3, this clicking-type writing implement incorporates a writing member using medium-viscosity ink 11. In this writing implement, a check ball 13 is accommodated in a joint 12. During ordinary writing, the flow path of the ink 11 is assured to extend from an ink-containing tube 10 having a plug 7 to a writing ball 15. When this writing implement is set upright, the check ball 13 comes into tight contact with a seat 12-*a* of the joint 12 to prevent the back leaking of the ink. In the case of a direct-supply writing member storing the medium-viscosity ink 11, which tends to cause a problem especially when being stored in a pocket, medium-viscosity ink 11 with a viscosity of 10 cp to 3,000 cp having thixotropic properties is filled in the ink-containing tube 10. The thixotropic properties of the ink 11 provide a high viscosity when the ink is in the static state. When the tip ball 15 rotates during writing, the viscosity of the ink decreases to allow flowout of the ink. Furthermore, a greasy, low-volatile follower 9 is filled in the rear end of the ink tube 10 behind the ink 11. The follower 9 contacts the ink surface and, as the ink is consumed, moves to follow the ink surface. A resin follower rod 8 having a specific weight substantially equal to that of the follower 9 is inserted in the follower 9 to increase the flow resistance. In the writing portion, the writing ball 15 and a spring 16, that presses the writing ball 15 with a force of about 1 g to 40 g, are incorporated in a tip 14 to form a ball valve mechanism. A hot-melt type tip sealing member 17 which melts at a temperature of 80° C. to 150° C. is attached to the tip of the writing portion to suppress volatilization of the ink 11 and to protect the tip of the writing portion. Consequently, problems that may occur after the manufacture and before use can be avoided by this arrangement. A transparent PP resin molded product or the like is used, for example, as the ink-containing tube 10, so that the remaining amount of ink 11 can be visually confirmed.

In the present clicking-type writing implement, the writing member having the writing portion at its tip is urged toward the rear of the barrel cylinder by a return spring 6 disposed between the writing portion and a flange 12-*b* of the ink-containing tube 10. The urging force of the return spring 6 is transmitted to a rotor 3, a clicking rod 5, and finally a projection 2-*e* formed on a clip cylinder 2, and is received by the end face of an engaging groove 1-*b* formed in a barrel cylinder 1.

FIG. 9 includes partial views of the barrel cylinder 1, the clip cylinder 2, the rotor 3, and the clicking rod 5 and front views showing the position of the rotor 3 progressively in the operational flow of the clicking mechanism. The operation of the clicking mechanism flows in the order of A, B, C, and D to finally return to the state of A. During this period of time, the projecting/retracting operation of the writing portion is performed once. The clicking mechanism will be described based on this operational flow.

The rotor 3 is interposed between the clicking rod 5 and the writing member. When the clicking rod 5 is pressed, the force applied in the axial direction is converted into a rotating force in the circumferential direction by a cam inclined surface 5-*a* of the clicking rod 5 and a corresponding cam inclined surface 3-*c* of the rotor 3. The clicking rod 5 is formed with a rotation stopper 5-*b*, and a groove 2-*d* corresponding to the rotation stopper 5-*b* is formed in the clip cylinder 2. Therefore, the clicking rod 5 does not rotate in the circumferential direction, and only the rotor 3 rotates through a predetermined angle in the circumferential direction. At the initial stage of the clicking operation, the rotation is regulated by a cam side surface 3-*e* of the rotor 3 and a side surface 1-*c* of the cam of the barrel cylinder 1 such that the rotor 3 does not rotate. After the clicking operation has been performed for a predetermined distance, i.e., the clicking rod 5 has been depressed for a predetermined distance, this regulation against rotation ends and the rotor 3 rotates through a predetermined angle. At this point, the rotor 3 is constantly urged rearwardly by the return spring 6 through the writing member. When depression of the clicking rod 5 is stopped, the rotor 3 is further rotated through a predetermined angle, under the urging of the return spring, by engagement of a cam projection inclined surface 3-*a* of the rotor 3 and a corresponding cam inclined surface 1-*a* of the barrel cylinder 1. When the rotor 3 has rotated through the predetermined angle, an engaging portion 3-*b* of the rotor 3 engages an engaging surface 2-*a* of the clip cylinder 2 as the writing portion projects from a front pipe 4.

Transition from the state B to the state C of FIG. 9 will be described. The cam projection inclined surface 3-*a* of the rotor 3 moves rearwardly along the cam inclined surface 1-*a* of the barrel cylinder 1, and simultaneously the engaging portion 3-*b* of the rotor 3 also moves along the same track as that of the cam inclined surface 1-*a*. At this point, to allow the engaging portion 3-*b* of the rotor 3 to engage with the engaging surface 2-*a* of the clip cylinder 2, the engaging portion 3-*b* must be able to pass without interference from the lower end face of a side wall surface 2-*b* of the engaging surface 2-*a*. For this purpose, a distance R through which the cam projection inclined surface 3-*a* of the rotor 3 moves may be set to be sufficiently large, or an inclined angle Θ of the cam inclined surface 1-*a* of the barrel cylinder 1 may be set to an obtuse angle. With the former method, the clicking stroke is increased, thus hindering operability. With the latter method, the cam projection inclined surface 3-*a* of the rotor 3 may undesirably be stopped on the cam inclined surface 1-*a* of the barrel cylinder 1, resulting in reduced operational reliability. In order to solve this problem, the lower end face of the side wall surface 2-*b* of the clip cylinder 2 may be set at such a height that the engaging portion 3-*b* of the rotor 3 can pass it without interference. If, however, the lower end face of another side wall surface 2-*c* is set at the same height as that of the lower end face of the side wall surface 2-*b*, engagement of the engaging portion 3-*b* and the engaging surface 2-*a* cannot be guaranteed. As a consequence, the lower end face of the side wall surface 2-*c* is preferably increased within a range that does not interfere with the outer diameter of the cylinder of the rotor 3. If the end face of the engaging surface 2-*a* of the clip cylinder 2 is formed into an inclined surface or a curved surface smoothly connecting the lower end face of the side wall surface 2-*b* and the lower end face of the side wall surface 2-*c*, the clip can be engaged with and disengaged from clothes smoothly without being caught by the clothes.

When the clicking rod 5 is depressed while the writing portion projects from the front pipe 4, the engaging surface 2-*a* and engaging portion 3-*b* of the rotor 3 are disengaged from each other by the operation of the cam inclined surface 5-*a* of the clicking rod 5 and of the cam inclined surface 3-*c* of the rotor 3. When depression of the clicking rod 5 is stopped, the cam projection inclined surface 3-*a* of the rotor 3 moves rearwardly while rotating along the cam inclined surface 1-*a* of the barrel cylinder 1, and the writing portion is retracted into the barrel cylinder. At this point in the operational flow, the rotor 3 is set at the same position as that in the initial state. In other words, when the clicking rod 5 is depressed again, the writing portion can be projected.

Alternatively, the writing portion may be retracted from the projecting state by lifting the clip. When the clip is lifted, the engaging portion 3-*b* of the rotor 3 and the engaging surface 2-*a* of the clip cylinder 2 disengage from each other, without a need for depressing the clicking rod 5, and the writing portion is retracted in the barrel cylinder in the same manner as in a case wherein the clicking rod 5 is depressed. When the user puts the clicking-type writing implement in his pocket with the writing portion projecting, the clip is lifted so that the writing portion is retracted automatically, and thus it will not accidentally stain the clothes of the user. Regarding the cam inclined surface required for these operations, the shapes, angles, and number of cams can be selected as required.

In the writing implement according to the present invention, a projection 5-*c* of the clicking rod 5, a projection 3-*d* of the rotor 3, the rotation stopper 5-*b* of the clicking rod 5, the projection 2-*e* of the clip cylinder 2, a projection 2-*f* of the clip cylinder 2, and the engaging groove 1-*b* of the barrel cylinder 1 engage each other as required when the clicking rod 5, the rotor 3, and the clip cylinder 2 are assembled in the barrel cylinder 1. Accordingly, the components of the writing member can be prevented from being separated during an exchange of the writing member.

As other embodiments of the present invention, a so-called water-soluble type ball-point pen using a water-soluble ink and tampon of a fiber bundle as an ink occluding member, an oil-based type ball-point pen using oil-based ink having a lower viscosity than ordinary ink, a clicking-type writing implement obtained by forming a so-called marking pen or a marker, using a fiber bundle as the pen tip and utilizing capillarity in the interior, into the form of a writing member, and the like can be employed as required. With these embodiments, the same effect as that of the present invention can be obtained.

The present invention results in a high-safety clicking-type writing implement capable of preventing accidental staining of clothes. Moreover, the writing implement of the present invention is more convenient, since the writing portion can be projected or retracted merely by depressing the clicking rod. As the structure is simple, assembly is easy, leading to a low price. As the writing member is projected or retracted by repeatedly depressing the clicking rod, the user's finger is in contact with the clicking rod to reduce the impact applied to the writing member during retraction. Thus, the ink will not be moved within the ink tube in the writing member by an impact during retraction of the writing portion into the barrel cylinder.

What is claimed is:

1. A writing implement comprising:

a barrel cylinder having a front end, a rear end and a longitudinal axis extending from the front end to the rear end;

a writing member in the barrel cylinder, the writing member having a writing portion proximal to the front end of the barrel cylinder, the writing member movable in the barrel cylinder such that the writing portion can be protracted and retracted from the front end of the barrel cylinder;

a return spring for urging the writing member toward the rear end of the barrel cylinder;

a clicking rod having a portion projecting from the rear end of the barrel cylinder;

a double clicking mechanism connected to the writing member for protracting and retracting the writing portion from the front end of the barrel cylinder, the mechanism comprising:

a rotor actuated by the clicking rod;

a cam surface integrally formed on and extending radially inwardly from an inner surface of the barrel cylinder, the cam surface inclined along the longitudinal axis:

a cam projection extending from the rotor, the cam projection having a cam projection inclined surface slidably engaging the cam surface of the barrel cylinder in order to project and retract the writing portion;

a safety mechanism, comprising:

an engaging portion extending outwardly from the rotor, the engaging portion spaced apart from and positioned forward of the cam projection;

a clip extending longitudinally along an outside surface of the barrel cylinder; and first and second engaging surfaces extending radially inwardly from the clip, the clip being biased to position the first and second engaging surfaces to engage the engaging portion of the rotor when the writing portion is protracted, the first engaging surface preventing rearward movement of the writing portion in an axial direction, and the second engaging surface preventing rotation of the rotor about the longitudinal axis, such that when the clip is lifted, the first and second engaging surfaces disengage from the engaging portion of the rotor so that the writing portion can retract.

2. A writing implement according to claim 1 wherein the rotor has an axial center about which the engaging portion of the rotor travels, the first engaging surface has opposite first and second side walls each having a lower end face, and a distance from the lower end face of the first side wall to the axial center is greater than a distance from the lower end face of the second side wall to the axial center.

* * * * *